US006092481A

United States Patent [19]

Starbuck et al.

[11] Patent Number: 6,092,481

[45] Date of Patent: Jul. 25, 2000

[54] SAILING RIG

[75] Inventors: David Starbuck, Kula; Barry Spanier, Haiku, both of Hi.

[73] Assignee: Neil Pryde Limited, The Hong Kong Special Administrative Region of the People's Republic of China

[21] Appl. No.: 09/060,672

[22] Filed: Apr. 15, 1998

[30] Foreign Application Priority Data

Feb. 20, 1998 [DE] Germany ..... 298 03 035 U

[51] Int. Cl.[7] ..... B63B 15/00

[52] U.S. Cl. ..... 114/90; 114/97

[58] Field of Search ..... 114/89, 90, 91, 114/94, 97, 39.12

[56] References Cited

U.S. PATENT DOCUMENTS 4,964,353 10/1990 Morrelli ..... 114/90

4,977,843 12/1990 Ewert et al. ..... 114/109

*Primary Examiner*—Sherman Basinger

*Attorney, Agent, or Firm*—Jackson Walker L.L.P.

[57] ABSTRACT

A windsurfer sailing rig includes a mast with a top mast extension. A swivel connection connects the extension to the top of the mast. In use, down haul tension for the mast is applied to hold the swivel connection downwards in position.

2 Claims, 2 Drawing Sheets

SAILING RIG

BACKGROUND OF THE INVENTION

1. Field of the Invention

The invention relates to sailing rigs.

2. Description of Prior Art

The invention relates more particularly although not exclusively to a sailing rig for a windsurfer.

The sail of a windsurfer is fitted to a mast and down tension applied to bend the mast to a desired shape. It has been proposed to apply tension to the top of the mast to cause bending of the mast but to provide a top mast tip that extends above the top of the mast and fits inside the top of the sail. The mast tip is relatively flexible as compared to the rest of the mast. The top mast tip is bent when the sail is rigged and bent more as load on the sail is increased while sailing. This pulls up the leech of the sail. The sail however becomes unpredictable and the top of the sail waves about in strong wind conditions. If the tip is made less flexible, the load on the leech is greater and prevents twist that is necessary for good balance in strong winds.

SUMMARY OF THE INVENTION

It is an object of the invention to overcome or at least reduce one or more of these problems.

According to the invention there is provided a sailing rig having a mast to which down haul is applied at the top of the mast and a top mast extension that fits to the top of the sail and has a swivel connection for the top mast extension that fits to the top of the mast.

Preferably, the swivel connection is held in position by applying down haul tension of the mast to the swivel connection that holds the top mast extension down against the top of the mast.

The swivel connection may be formed with a pivoting axis that is arranged to flex to some extent in relation to a longitudinal axis of the mast.

BRIEF DESCRIPTION OF THE DRAWINGS

A windsurfer sail rig according to the invention will now be described by way of example with reference to the accompanying drawing in which.

DESCRIPTION OF THE PREFERRED EMBODIMENT

Figure 1:
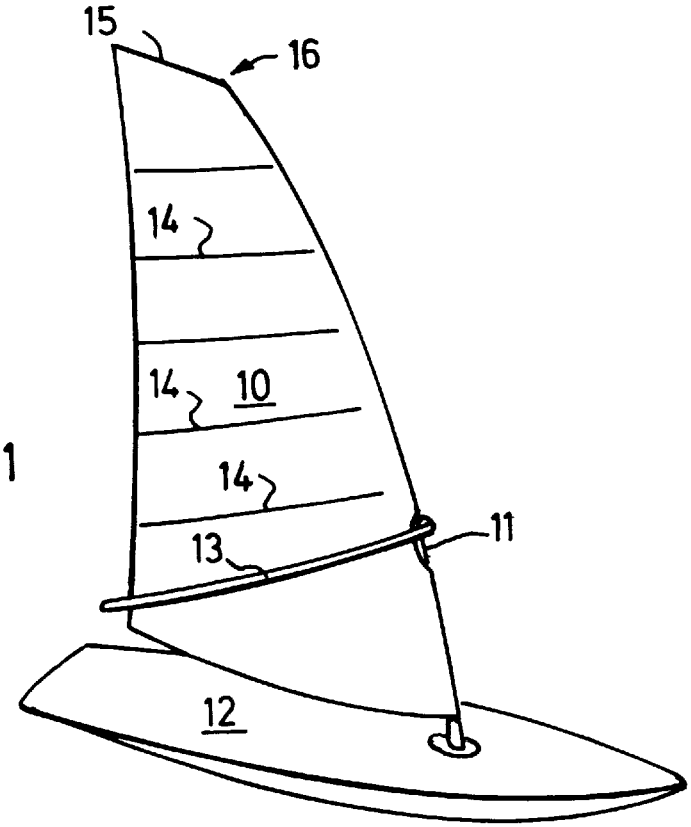
FIG. 1 shows an isometric view of a windsurfer and sail rig.

Referring to the drawings, in FIG. 1, a sail 10 is supported by a mast 11 in conventional manner, which is pivotably attached to a sail board 12. A boom 13 extends around the sail and a number of battens 14 are fitted across the sail. Down haul tension is applied at top of the mast to bend the mast, when the sail is rigged, in a manner that is in principle already known.

Figure 2:
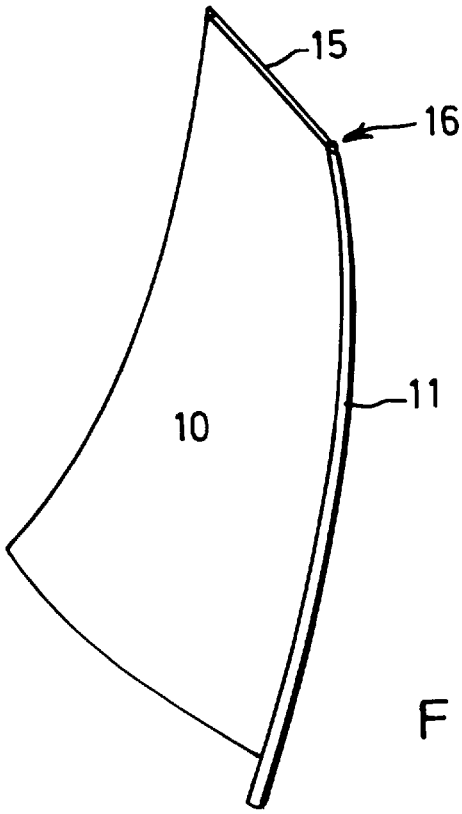
FIG. 2 shows diagrammatically the sail rig.
Figure 3:
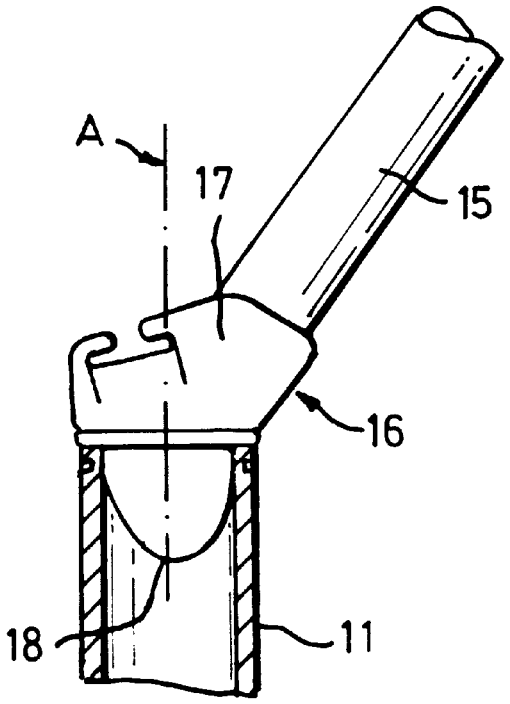
FIG. 3 shows partly sectioned a swivel connection of the sail rig.
Figure 4:
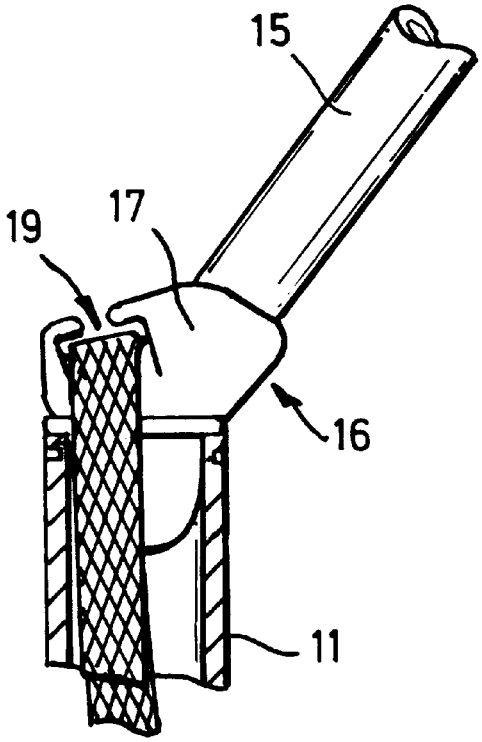
FIG. 4 shows FIG. 3 with a down haul webbing in position.

A top mast extension 15 is fitted to the top of the mast 11. A swivel connection 16 allows the top mast extension 15 to swivel in relation to a longitudinal axis of the mast, as shown in FIG. 2. The swivel connection 16 comprises a shaped body 17 with a downwardly extending protrusion 18 that fits snugly into an upper end of the mast 11 so that the top mast extension 15 can swivel about the longitudinal axis A as required. The down haul tension is applied to the mast by webbing 19 (see FIG. 4). This tension holds the body 17 firmly down against the top the mast 11 and bend the mast 11 as required. Under normal conditions the swivel connection 16 usually remains in the configuration shown in FIGS. 3 and 4.

Figure 5:
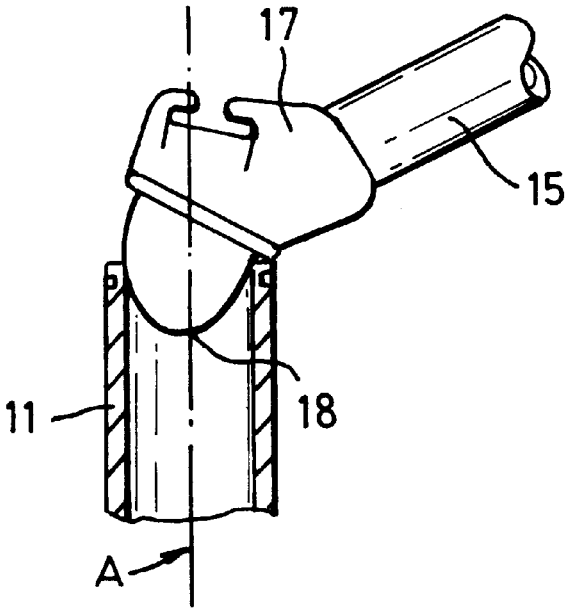
FIG. 5 shows a configuration of the swivel connection under excessive load.

It will be noted that the protrusion 18 is radiussed. In case of a severe impact or excessive load, the radius allows the extension 15 to fold down (see FIG. 5) without causing stress to the top of the mast 11, the extension 15, or the swivel connection 16. As soon as the excessive load ends the spring in the mast returns the swivel connection to the normal position shown in FIG. 3.

It will also be noted that the described arrangement the down haul webbing 19 (see FIG. 4) crosses over the swivel connection towards a front of the body 17. As such this serves to better counteract downward forces acting on a rear of the extension 15 during sailing.

In use, the described sail rig shifts sail area to the top aft of the sail. This reduces aerodynamic drag and improves the stability in two ways. Firstly, the extension 15 is free to rotate at the top of the mast 11 and it is loaded in compression. Consequently when the extension 15 rotates, the leech tightens and the sail 10 becomes more solid and stable. Secondly, aerodynamic stability is increased because twist now starts at a top aft point of the sail where the area of the sail is passing through the air at the lowest angle of attack. When the wind angle suddenly changes to windward, in a gust of wind for instance, the main body of the sail will tend to stall and lose efficiency. In this situation the top aft of the sail becomes more powerful because it goes to a higher angle which produces more lift. This brings the main body of the sail back to a more optimum angle which helps the sail to feel locked-in and provides a larger "sweet-spot".

In earlier arrangements, tip air releases along the radius of the aft of the head of the sail. Drag is reduced in the described sail rig because air flows off a rear tip or point. This reduces swirl at the head of the sail, that is to say the "vortex", which contributes 50% of induced drag or more than 50% when heading up wind. This drag reduction in the described sail rig thus provides an especial advantage at top speed and heading up wind.

The described top mast extension is made of rigid material, and in an alternative arrangement the top mast extension is spring biassed downwards at the swivel connection to allow for any excessive loads mentioned earlier. Such loads might be the result of the extension striking the ground for example, before the rigged mast is fitted to the sail board 10.

The described sailing rig may be used on vessels other than windsurfers. In particular, "windsurfer" type sailing rigs are presently often attached or used on small dinghies and the like where the described sailing rig would be equally useful and advantageous.

We claim:

1. A mast extension assembly for a windsurfer sailing rig having a mast with a longitudinal axis and a downhaul tension member comprising:

a mast extension arm having proximal and distal ends;

a mast connection member to receive and retain said arm above an uppermost end of said mast further comprising:

an opening to receive and retain said proximal end of said mast extension arm;

a radiused protrusion stub adapted to pivotally fit into said uppermost end of said mast;

and a downhaul tension member receiving portion aligned along said longitudinal axis of said mast, said downhaul tension member urging said protrusion into a first position into said mast along said longitudinal axis.

2. The assembly of claim 1 wherein the radius of said protrusion is sized to allow said connection member to move to a second position wherein said mast extension arm is folded downwardly to a second unloaded position when excessive load or impact is applied to said arm, and returnable to said first position when said excessive load or impact is removed.

* * * * *